United States Patent [19]

Cheadle

[11] 4,065,328

[45] Dec. 27, 1977

[54] HIGH STRENGTH SN-MO-NB-ZR ALLOY TUBES AND METHOD OF MAKING SAME

[75] Inventor: Brian A. Cheadle, Deep River, Canada

[73] Assignee: Atomic Energy of Canada Limited, Ottawa, Canada

[21] Appl. No.: 681,293

[22] Filed: Apr. 28, 1976

[30] Foreign Application Priority Data

May 6, 1975 Canada ..... 226385

[51] Int. Cl.[2] ..... C22F 1/18; C22C 16/00

[52] U.S. Cl. ..... 148/12.7 B; 75/177; 148/32.5; 176/88

[58] Field of Search ..... 148/11.5 F, 12.7 B, 148/32.5; 75/177; 176/88

[56] References Cited

U.S. PATENT DOCUMENTS 4,000,013 12/1976 MacEwen ..... 75/177

FOREIGN PATENT DOCUMENTS 932,336 7/1963 United Kingdom ..... 148/11.5 F

OTHER PUBLICATIONS

Cheadle, et al; "Development of Texture and Structure in Zr-2.5 wt% Nb Extruded Tubes", Can. Met. Qtly., vol. 11, No. 1 (1972), pp. 121–127.

Ibrahim et al; "Creep and Stress-Rupture of High Strength Zirconium Alloys," Can. Met. Qtly., vol. 11, No. 1, (1972), pp. 273–283.

*Primary Examiner*—Arthur J. Steiner

*Attorney, Agent, or Firm*—Alex. E. MacRae & Co.

[57] ABSTRACT

Tubes for use in nuclear reactors fabricated from a quaternary alloy comprising 2.5–4.0 wt% Sn, 0.5–1.5 wt% Mo, 0.5–1.5 wt% Nb, balance essentially Zr. The tubes are fabricated by a process of hot extrusion, heat treatment, cold working to size and age hardening, so as to produce a microstructure comprising elongated $\alpha$ grains with an acicular transformed $\beta$ grain boundary phase.

9 Claims, 12 Drawing Figures

HIGH STRENGTH SN-MO-NB-ZR ALLOY TUBES AND METHOD OF MAKING SAME

This invention relates to zirconium alloy tubes especially for use in nuclear applications. More particularly, this invention relates to Zr-Sn-Mo-Nb alloy tubes which have been extruded in the temperature range 800°-900° C and immediately following extrusion cooled at a controlled rate, and subsequently cold worked to size and age hardened. Conventionally, pressure tubes for use in CANDU nuclear reactors, are fabricated by extrusion of Zr-2.5 wt% Nb billets, followed by cold working and age hardening. It has been found (vide. Cheadle et al, Canadian Metallurgical Quarterly, Vol. 11, No. 1 (1972) 121) that the hot extrusion process develops a two-phase microstructure of strongly textured $\alpha$ grains and a grain boundary network of a cubic $\beta$-phase. The extrusion process itself determines the texture and microstructure of the finished tubes, provided they are not heated above 600° C at any stage during fabrication. The flow pattern as the metal moves through the die determines the direction of major compressive strain and hence the texture of the extruded tube. The flow pattern is controlled by both the shape of the die, the extrusion ratio and the friction at the billet surfaces. The structure of the preheated billet for extrusion can affect the $\alpha$ grain size in the extruded tube. A smaller $\alpha$ grain size in the preheated billets produces a smaller $\alpha$ grain size in the extruded tube. The cooling rate after extrusion is, however, very important. When the cooling rate is about 2° C per minute the $\beta$-phase transforms to $\alpha$ by growth on the $\alpha$ present during extrusion and the structure and texture rate are controlled by the extrusion process. When the cooling rate is faster than about 11° C per second the $\beta$-phase transforms to randomly oriented $\alpha$ needles and a duplex structure is produced. The proportions of the two structures and textures depend on the temperature of the extruded tube. Other workers have determined that other alloys can also be used economically in CANDU type reactors provided there is no increase in neutron capture cross-section and have suggested that zirconium based alloys with small additions of tin, molybdenum, niobium and aluminum are much stronger than the more usual Zircaloy-2 or Zr-2.5% Nb alloys (vide Ibrahim et al, Canadian Metallurgical Quarterly, Vol. 11, No. 1 (1972) 273). In particular these workers found that quarternary alloys containing 3% Sn, 1% Mo, 1% Nb, balance Zr offer high creep strength, low neutran capture cross-section and reasonable corrosion resistance.

Unless otherwise stated, all alloy percentages in this specification are percentages by weight.

An object of the present invention is, therefore, to provide improved tubes for reactor use from an alloy composition of Sn 2.5–4.0%, Mo 0.5–1.5%, O 800–1300 ppm balance Zr and said tubes having yield strengths (0.2%) of the order of 60–85 k psi and tensile strengths of the order of 90–85 k psi.

Another object of the invention is to provide a process for heat treating the extrusion so as to achieve a duplex microstructure comprising a primary $\alpha$-phase and a complex acicular grain boundary phase.

Thus, by one aspect of the invention there is provided an extruded alloy tube consisting essentially of Sn 2.5–4.0%, Mo 0.5–1.5%, Nb 0.5–1.5%, O 800–1300 ppm, balance Zr and incidental impurities and having a microstructure comprising hexagonal $\alpha$ grains elongated in the extrusion direction and an acicular grain boundary phase.

By another aspect of the invention there is provided a method of fabricating extruded alloy tubes from an alloy consisting essentially of Sn 2.5–4.0%, Mo 0.5–1.5%, Nb 0.5–1.5%, O 800–1300 ppm, balance Zr and incidental impurities, in which the alloy is preheated to a temperature in the range 850°-900° C, extruded through a tube forming die, cold worked to size and age hardened by heating at a temperature in the range between 400° and 500° C, and specifically including the step of cooling said extruded tube immediately following extrustion at a rate of at least 30° C per second, so as to develop a microstructure comprising hexagonal $\alpha$ grains elongated in the extrusion direction and an acicular grain boundary phase.

The invention will be described in more detail hereinafter with reference to the accompanying drawings in which:

FIG. 1*a* is an electron micrograph at × 11,500 of an alloy comprising Sn 2.5–4.0%, Mo 0.5–1.5%, Nb 0.5–1.5%, O 800–1300 ppm, balance Zr, air cooled from 900° C. The structure consists of hexagonal $\alpha$ grains, Widmanstatten $\alpha$ grains and grain boundary cubic $\beta$-phase.

FIG. 1*b* is an electron micrograph of the alloy as in FIG. 1*a* at a magnification of 23,000.

Figure 1B:
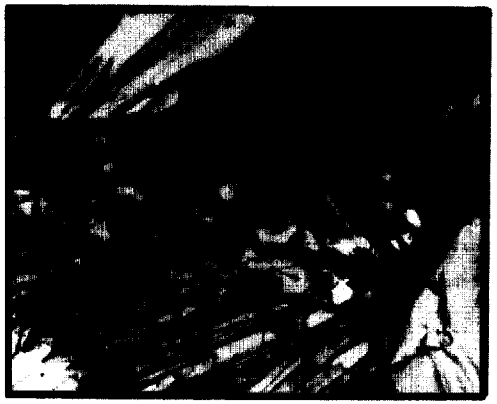
Figure 3:
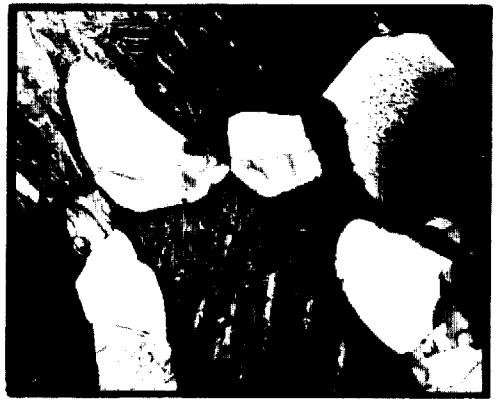
FIG. 3 is an electron micrograph at × 6,000 of the alloy as in FIG. 1 cooled from 900° C by water jets. The structure consists of hexagonal $\alpha$ grains and an acicular $\alpha'$ phase.
Figure 1A:
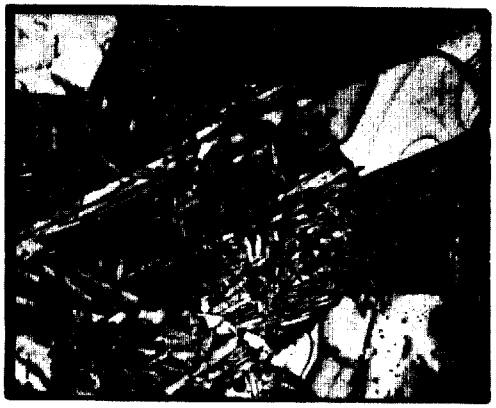
Figure 2:
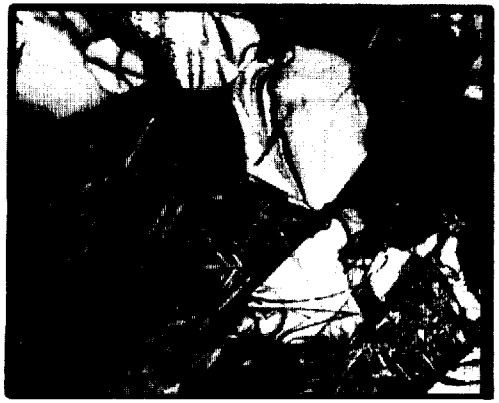
FIG. 2 is an electron micrograph at × 11,500 of the alloy as in FIG. 1 cooled from 900° C by air jets. The structure consists of hexagonal $\alpha$ grains and a complex acicular transformed $\beta$-phase.
Figure 5:
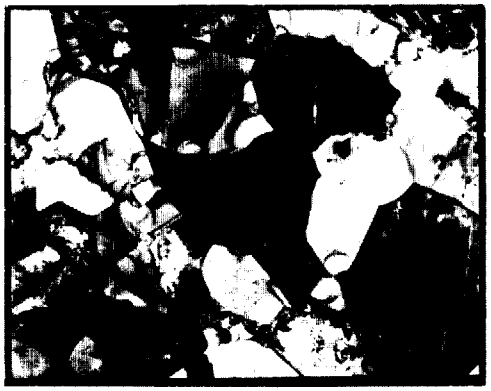
FIG. 5 is an electron micrograph at × 11,500 of the alloy as in FIG. 1 air cooled from 850° C. The structure consists of hexagonal $\alpha$ grains and a complex structure of transformed $\beta$ phase.
Figure 7:
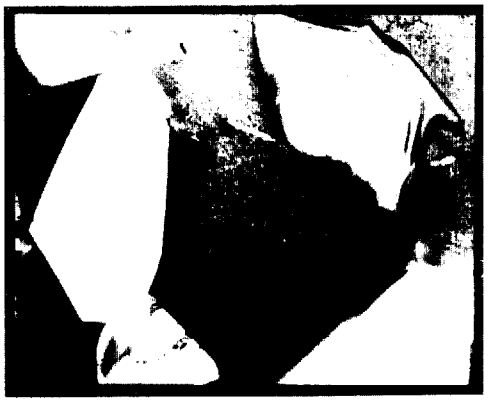
FIG. 7 is an electron micrograph at × 23,000 of the alloy as in FIG. 1 cooled from 850° C by water jets. The structure consists of hexagonal $\alpha$ grains and $\omega$ phase.
Figure 4:
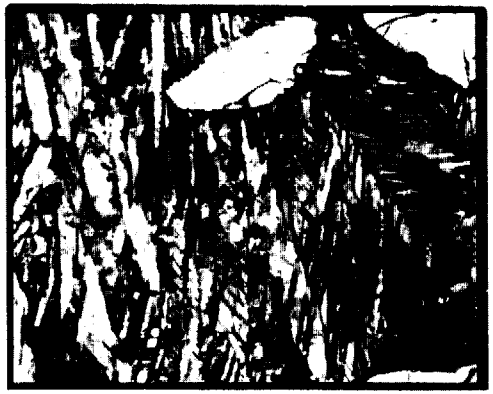
FIG. 4 is an electron micrograph at × 11,500 of the alloy as in FIG. 1 water quenched from 900° C. The structure consists of hexagonal $\alpha$ grains and a martensitic $\alpha'$ phase.
Figure 6:
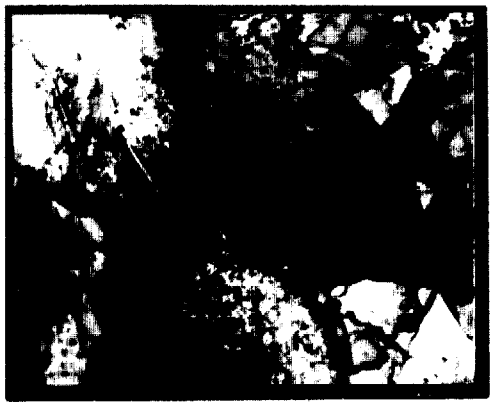
FIG. 6 is an electron micrograph at × 23,000 of the alloy as in FIG. 1 cooled from 850° C by air jets. The structure consists of hexagonal $\alpha$ grains and a complex structure of transformed $\beta$ phase.

Both heat treatment temperature and cooling rate have a large effect on the microstructure and mechanical properties of the alloy Sn 2.5–4.0%, Mo 0.5–1.5%, Nb 0.5–1.5%, O 800–1300 ppm, balance Zr. In the temperature range 700°-950° C the structure of the alloy consists of hexagonal $\alpha$ and cubic $\beta$ phases. The higher the temperature in this range the larger is the proportion of the $\beta$ phase. The two $\beta$ stabilizing elements Mo and Nb both have a low solubility in the $\alpha$ phase hence at the lower temperatures the smaller volume of $\beta$ phase is enriched in Mo and Nb. Hence on rapid cooling from 850° C the $\beta$ phase transforms to the $\omega$ phase but if the alloy is rapidly cooled from 900° C the $\beta$ phase does not contain sufficient Mo and Nb for this transformation to occur. Table 1 shows the wide variation in tensile strength and microstructure that can be obtained in this alloy with different heat treatment conditions. Typical microstructures are shown in FIGS. 1–8.

TABLE 1

| Solution Temp. ° C | Cooling Conditions | Cooling Rate ° C/S | Microstructure | 0.2% YS kpsi | 0.2% YS MPa | UTS kpsi | UTS MPA | % EL | % RA |
|---|---|---|---|---|---|---|---|---|---|
| | Still air | 8 | $\alpha$ + complex transformed $\beta$ | 65 | 447 | 89 | 612 | 9 | 23 |
| | Air jets | 10 | $\alpha$ + complex transformed $\beta$ | 62 | 426 | 96 | 661 | 4 | 28 |
| 850 | Water jets | 35 | $\alpha + \omega$ | 60 | 414 | 90 | 620 | 5 | 38 |
| | Quenched in water | > 100 | $\alpha + \omega$ | 71 | 489 | 90 | 620 | 11 | 28 |
| | Still air | 8 | $\alpha$ + Widmanstatten $\alpha + \beta$ | 68 | 469 | 84 | 579 | 11 | 30 |
| | Air jets | 10 | $\alpha$ + complex transformed $\beta$ | 71 | 489 | 110 | 758 | 6 | 39 |
| 900 | Water jets | 35 | $\alpha$ + acicular $\alpha$ | 87 | 599 | 129 | 889 | 5 | 24 |
| | Quenched in water | > 100 | $\alpha$ + martensitic $\alpha'$ needles | 94 | 646 | 118 | 814 | 13 | 25 |

High strength extruded tubes according to the present invention have been fabricated from alloy billets having a composition in the range:

Sn: 2.5 - 4.0%
Mo: 0.5 - 1.5%
Nb: 0.5 - 1.5%
O: 800 - 1300 ppm
Balance Zr + incidental impurities In a typical practice of this invention, hollow alloy billets are preheated to a temperature in the range 850° - 900° C, extruded through a tube forming die in a manner known per se, using an extrusion ratio in the range 5:1 to 25:1 and preferably 15:1 to form a hollow tube. The extruded tubes are then fast cooled to room temperature by use of either an air blast or by water spray cooling on the outside surface of the tube thereby achieving a cooling rate of at least 30° C per second and preferably of the order of between 30° and 100° C per second. The extruded tubes are then cold worked to size and then age hardened by heating in air in the temperature range 400° - 500° C.

use of a water spray. Other extruded tubes were slow cooled in still air. All tubes were then cold worked to a wall thickness of 0.160 in. and age hardened by heating in air to a temperature of 400° C for 24 hours.

Figure 9:
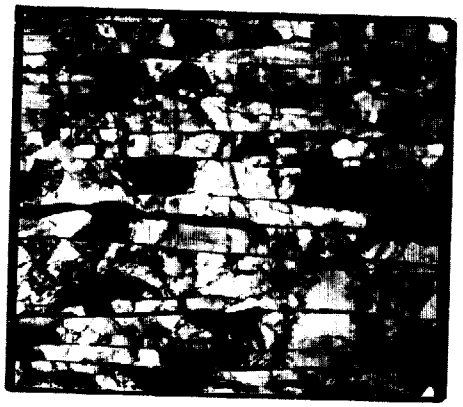
FIG. 9 is an electron micrograph at × 10,000 of a tube extruded at 850° C and air cooled.
Figure 10:
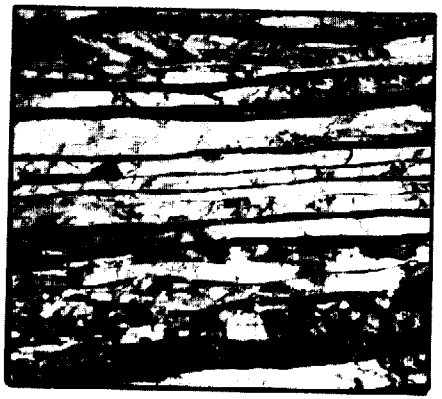
FIG. 10 is an electron micrograph at × 10,000 of a tube extruded at 850° C and cooled rapidly.
Figure 8:
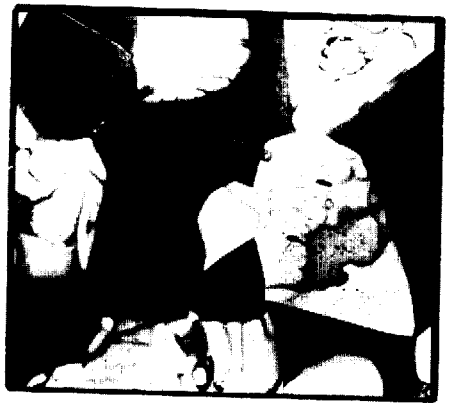
FIG. 8 is an electron micrograph at × 11,500 of the alloy as in FIG. 1 water quenched from 850° C. The structure consists of hexagonal $\alpha$ grains and $\omega$ phase.
Figure 11:
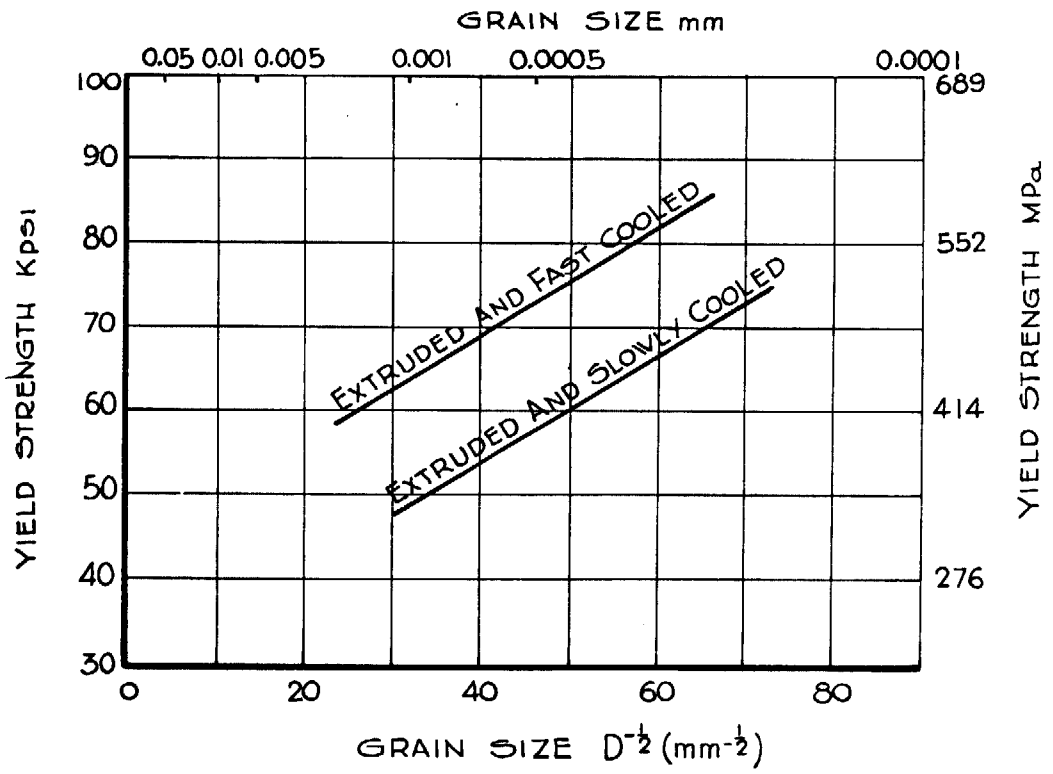
FIG. 11 is a graph showing the effect of grain size on the longitudinal strength of alloy tubes of the present invention.

Following fabrication and heat treating the alloy tubes were examined microscopically and it was found the structure of the slow cooled tubes comprised elongated $\alpha$ grains and a grain boundary phase of cubic $\beta$, as shown in FIG. 9 whereas the structure of the fast cooled alloy comprised elongated $\alpha$ grains and an acicular $\alpha'$ phase between the $\alpha$ grains as shown in FIG. 10.

The extrusion process had produced a strong crystallographic texture in the hexagonal $\alpha$ grains and the majority were oriented with their basal plane normals close to the circumferential direction of the tube. Analysis of the two phases in the slow cooled tubes indicated compositions as follows:

| | Mo | Sn | Nb | Zr |
|---|---|---|---|---|
| $\alpha$ grains | 0–0.5% | 3.5–4.5% | 0–0.5% | bal. |
| Grain boundary phase | 3–4.5% | 0.5–1.5% | 2.4–3.5% | bal. |

The acicular $\alpha'$ structure was too complex for analysis of its composition.

The mechanical properties of the tubes at 300° C were then assessed and are tabulated hereinbelow in Table 2.

TABLE 2

Typical longitudinal tensile properties of alloy tubes at 300° C

| Tube Fabrication Method | 0.2% YS kpsi | 0.2% YS MPa | UTS kpsi | UTS MPa | % El | % RA | $\alpha$ grain size in tube thickness direction mm |
|---|---|---|---|---|---|---|---|
| Extruded, slowly | 55 | 375 | 70 | 480 | 17 | 55 | 0.0007 |
| cooled in air | 65 | 450 | 80 | 555 | 12 | 60 | 0.0003 |
| Extruded, slowly cooled in air, cold worked 20% | 80 | 550 | 90 | 620 | 12 | 45 | 0.0004 |
| Extruded, rapidly cooled | 60 | 410 | 80 | 550 | 15 | 50 | 0.0009 |
| | 85 | 600 | 105 | 725 | 11 | 45 | 0.0003 |

EXAMPLE 1

Hollow alloy billets approximately 17 in. long × 8 in. outside diameter × 4 in. inside diameter analyzing 3.3% Sn, 1.0% Mo, 0.75% Nb, balance Zr and incidental impurities were preheated to a temperature of 850° C, extruded through a tube forming die at an extrusion ratio of 14:1 to form a hollow tube 20 feet long, 4.5 in. diameter and with a wall thickness of 0.200 in. Some of the extruded tubes were rapidly cooled to room temperature as they emerged from the extrusion chambers by It will be appreciated that the mechanical properties are influenced by the extrusion conditions, the rate of cooling after extrusion and the amount of cold work. Varying the extrusion temperature and ratio will vary the $\alpha$ grain size, and if the tubes are slow cooled after extrusion the grain boundary phase is cubic $\beta$ whereas if the tubes are rapidly cooled after extrusion the grain boundary phase has a complex acicular structure. The combination of $\alpha$ grain size and grain boundary phase structure produces a marked effect upon the yield strength of the heat-treated tubes as shown in Table 2 and more vividly in FIG. 9, from which it can be seen that a remarkable improvement in yield strength is achieved by extrusion followed by fast cooling as compared to extrusion followed by slow cooling. To achieve the thin elongated grains in the tubes rapidly cooled after extrusion it is extremely important that the tube is cooled as soon as it emerges from the extrusion die. In the temperature range 875°-900° C the $\alpha$ grains rapidly coalesce and become more equiaxed.

The embodiments of the invention in which an exclusive property or privilege is claimed are defined as follows:

1. In a method of fabricating extruded alloy tubes from an alloy consisting essentially of Sn 2.5–4.0%, Mo 0.5–1.5%, Nb 0.5–1.5%, O 800–1300 ppm, balance Zr and incidental impurities, in which said alloy is preheated to a temperature in the range 850°-900° C, extruded through a tube forming die, cold worked to size and age hardened by heating at a temperature in the range between 400° and 500° C, the improvement comprising rapidly cooling said extruded tube immediately following extrusion at a rate of at least 30° C per second so as to develop a microstructure comprising hexagonal $\alpha$ grains elongated in the extrusion direction and an acicular grain boundary phase.

2. In a method of fabricating extruded alloy tubes as claimed in claim 1, the improvement wherein said tube is cooled after extrusion at a rate of 30° to 100° C per second.

3. In a method of fabricating alloy tubes as claimed in claim 1 the improvement comprising extruding said tubes at an extrusion ratio in the range 5:1 to 25:1.

4. A method of fabricating alloy tubes as claimed in claim 3 wherein said tubes are extruded at an extrusion ratio of 15:1.

5. A method of fabricating alloy tubes as claimed in claim 2 wherein said tubes are cooled after extrusion in an air blast.

6. A method of fabricating alloy tubes as claimed in claim 2 wherein said tubes are cooled after extrusion by water spray cooling.

7. A high strength extruded alloy tube made by the process of claim 1.

8. An extruded alloy tube as claimed in claim 7 having an ultimate tensile strength in the range 550–725 MPa.

9. An extruded alloy tube as claimed in claim 7 comprising 3.3% Sn, 1.0% Mo, 0.75% Nb, O 800–1300 ppm, balance Zr and incidental impurities.

* * * * *